US012612861B2

(12) United States Patent
Weaver et al.

(10) Patent No.: US 12,612,861 B2
(45) Date of Patent: Apr. 28, 2026

(54) ROCK BOLT

(71) Applicant: SANDVIK MINING AND CONSTRUCTION AUSTRALIA (PRODUCTION/SUPPLY) PTY LTD, Queensland (AU)

(72) Inventors: Steven Weaver, New South Wales (AU); Mietek Rataj, New South Wales (AU)

(73) Assignee: Sandvik Mining and Construction Australia (Production/Supply) Pty Ltd, Milton QLD (AU)

( * ) Notice: Subject to any disclaimer, the term of this patent is extended or adjusted under 35 U.S.C. 154(b) by 60 days.

(21) Appl. No.: 18/854,873

(22) PCT Filed: Mar. 30, 2023

(86) PCT No.: PCT/AU2023/050238

§ 371 (c)(1),
(2) Date: Oct. 7, 2024

(87) PCT Pub. No.: WO2023/193043

PCT Pub. Date: Oct. 12, 2023

(65) Prior Publication Data

US 2025/0264022 A1 Aug. 21, 2025

(30) Foreign Application Priority Data

Apr. 8, 2022 (EP) ..... 22167432

(51) Int. Cl.
*E21D 21/00* (2006.01)

(52) U.S. Cl.
CPC ..... *E21D 21/0033* (2013.01); *E21D 21/006* (2016.01); *E21D 21/008* (2013.01); *E21D 21/0086* (2013.01)

(58) Field of Classification Search
CPC . E21D 21/0033; E21D 21/006; E21D 21/008; E21D 21/0086; E21D 21/0026; E21D 21/004; E21D 21/0006
See application file for complete search history.

(56) References Cited

U.S. PATENT DOCUMENTS 2,804,797 A 9/1957 Seely
4,523,880 A 6/1985 Isler
(Continued)

FOREIGN PATENT DOCUMENTS

CN 110469353 A 11/2019
CN 110608061 A 12/2019
(Continued)

*Primary Examiner* — Benjamin F Fiorello
(74) *Attorney, Agent, or Firm* — Corinne R. Gorski

(57) ABSTRACT

A rock bolt includes a tube having a leading end and a trailing end. An expander mechanism is disposed within the tube near the leading end. An elongate bar is disposed within the tube and is connected at a first end with the expander mechanism and at a second end with an anchor arrangement positioned at the trailing end of the tube. The elongate bar is arranged to actuate the expander mechanism and remain connected between the expander mechanism and the anchor arrangement while the expander mechanism is actuated. The tube has a displaceable wall section at the leading end, which has a hinge end proximal the leading end connecting the displaceable wall section to the tube. The expander mechanism can be actuated to displace the displaceable wall section to rotate about the hinge end to shift the anchor end outwardly from the tube.

17 Claims, 2 Drawing Sheets

(56) References Cited

U.S. PATENT DOCUMENTS

| | | | | |
|---|---|---|---|---|
| 5,018,919 | A * | 5/1991 | Stephan | F16B 13/061 411/33 |
| 10,941,658 | B2 * | 3/2021 | Pastorino | E21D 21/008 |
| 2019/0390550 | A1 * | 12/2019 | Abreu | E21D 20/02 |
| 2020/0056479 | A1 * | 2/2020 | Xu | E21D 20/003 |

FOREIGN PATENT DOCUMENTS

| | | | |
|---|---|---|---|
| CN | 210483774 | U | 5/2020 |
| CN | 210948691 | U | 7/2020 |
| CN | 212027836 | U | 11/2020 |
| CN | 113047881 | A | 6/2021 |
| GB | 861685 | A | 2/1961 |
| GB | 1020865 | A | 2/1966 |
| KR | 1020100088469 | A | 8/2010 |
| WO | 2011020144 | A1 | 2/2011 |
| WO | 2017093138 | A1 | 6/2017 |
| WO | 2018206628 | A1 | 11/2018 |

* cited by examiner

ROCK BOLT

RELATED APPLICATION DATA

This application is a § 371 National Stage Application of PCT International Application No. PCT/AU2023/050238 filed Mar. 30, 2023, with priority to European patent application, 22167432.8, filed on 8 Apr. 2022, the contents of which is to be considered to be incorporated into this specification by this reference.

TECHNICAL FIELD

The present invention relates to a rock bolt for use in rock strata to and in particular, although not exclusively, to a rock bolt for use in rock strata that is weak or unstable.

BACKGROUND OF INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

Elongate bolts are used for reinforcing rock strata by inserting the bolt within a hole drilled into the rock strata and fixing the bolt within the hole. Bolts can be fixed within a hole by frictional engagement with the wall of the hole or they can be embedded within the hole within grout or resin. The trailing end of a bolt can extend out the open end of the hole and a rock plate can be attached to the trailing end and can be tightened to press firmly against the rock face that surrounds the hole opening. The fixing of the bolt within the hole resists egress of the bolt from the hole and the bolt supports the rock surrounding the hole against fracture. Likewise, the rock plate supports the rock face against fracture and displacement. Safety mesh can be installed broadly across the rock face by anchoring the mesh to multiple rock bolts. The rock bolts and the safety mesh thus combine to support the rock strata against fracture and collapse. The use of bolts and mesh is widespread in the underground mining industry to protect workers and equipment in underground mines and tunnels.

The strata conditions in underground mines can sometimes be weak, or even very weak, to the extent that the operating efficiency of currently used rock bolts is not sufficient without additional work to properly anchor the rock bolt within a bore drilled within the strata. Weak strata includes strata that has been consolidated by cement paste. Cement paste is used in underground mining to fill voids created during the mining or exploitation process, although the strength of the fill is very low, for example, about 5-10 MPa of uniaxial compressive strength. Often, subsequent exploitation in a mine is carried out next to such filled voids and that exploitation often exposes the cement paste fill. Because the strength of the fill is low, it needs to be reinforced, but this is very difficult using currently available rock bolts.

Standard friction bolts (known as "split sets") for example, rely on firm frictional engagement with the facing wall surface of a hole. A split set is installed in a hole that has an inside diameter that is less than the outside diameter of the tube of the split set when the split set is relaxed. The split set is percussively driven into the hole which requires the tube to contract or reduce in diameter. The split set is driven to an installation position and at that position, the tube forcibly and frictionally engages the inside wall of the hole with the hole wall resisting the tendency of the tube to expand. It is this between the outside of the tube and the inside wall of the hole that retains the split set in place within the hole.

Likewise, other forms of friction rock bolts have tubes and use expanders within the tubes to expand the tubes into frictional engagement with the inside wall of a drilled hole. The tubes of these rock bolts can be formed like a split set, but with the addition of an expander mechanism in order to increase the frictional force by which the tube of the rock bolt engages the facing surface of the hole wall.

A difficulty with the use of the above described rock bolts in weak strata is that it is more difficult and often impossible to drill a hole of sufficient diametric accuracy that the rock bolt can be expanded into firm frictional engagement with the inside wall of the hole. The hole that is formed will often end up of greater diameter than the drill bit and of variable diameter as the inside wall of the hole fractures, flakes or crumbles during the drilling process. Moreover, the percussion insertion of a rock bolt into the hole can further damage the inside wall of the hole, usually further increasing the hole diameter, at least in sections of the hole. The end result is that the rock bolt either cannot expand enough to engage the hole wall with sufficient frictional engagement, or simply cannot expand enough to engage the hole wall at all. Even if the rock bolt can be expanded into frictional engagement with the inside wall of the hole, often the compressive strength of the rock that forms the hole wall is low and can be readily crushed by the compressive forces exerted by the expander mechanism, leading to poor frictional engagement.

Because of the difficulty with the use of expanding rock bolts in weak strata, more often resin bolts are used, but these bolts also encounter their own difficulties, namely in relation to the poor mixing of the resin in oversized holes, and also in relation to the poor bond that the resin makes with the cement paste of the wall of the hole. The anchorage obtained is thus often relatively poor and not necessarily much better than the expanding rock bolts the resin bolts are used in preference to.

It is an object of the present invention to provide a rock bolt that addresses one or more of the difficulties associated with rock bolt anchorage in weak strata, or which provides consumers with an alternative to rock bolts that are currently available.

SUMMARY OF INVENTION

According to the present invention there is provided a rock bolt comprising:

- an elongate, generally circular tube, the tube having a leading end and a trailing end,
- an expander mechanism disposed within the tube in the region of the leading end,
- an elongate bar or cable disposed longitudinally within the tube and in connection at or towards a first end of the bar or cable with the expander mechanism and in connection at or towards a second and opposite end of the bar or cable with an anchor arrangement positioned at the trailing end of the tube, the elongate bar or cable being actuatable to actuate the expander mechanism and to remain connected between the expander mechanism and the anchor arrangement while the expander mechanism is actuated, characterised in that

- the tube has a displaceable wall section in the region of the leading end, the displaceable wall section having a hinge end proximal the leading end connecting the displaceable wall section to the tube, side walls extending from the hinge end to an anchor end distal to the leading end, the expander mechanism being actuatable to displace the displaceable wall section to rotate about the hinge end to shift the anchor end outwardly from the tube.

In a rock bolt according to the invention, the displaceable wall section advantageously is displaceable outwardly from the tube by the expander mechanism and by that outward displacement, the anchor end can be pushed to or into the surrounding strata to anchor the rock bolt within the hole, or to more firmly anchor the rock bolt within the hole if there is already some frictional anchorage achieved between the rock bolt and the tube. This differs from the expandable rock bolts discussed above, in which the outside of the rock bolt is pushed into firm frictional engagement with the hole wall either by the tube expanding (a standard split set) or by an expander mechanism expanding the tube, or from other forms of rock bolts that are anchored by resin or cement. In a rock bolt according to the present invention, the displaceable wall section is pushed or driven into the surrounding strata so that the anchor end of the displaceable wall section digs, gouges or embeds into the surrounding strata and thus resists movement of the rock bolt longitudinally within the hole. The resistance to longitudinal movement provided by displacement of the displaceable wall section into the surrounding strata is not necessarily longitudinally symmetrical. The resistance to movement of the rock bolt within a hole in a direction towards the trailing end of the bolt or towards the open or entry end of the hole will likely be higher than its resistance to movement towards the leading end of the bolt or towards the inner of the hole. Advantageously this is the effect that is desirable in a rock bolt.

A rock bolt according to the present invention advantageously takes advantage of the composition of the weak strata into which the rock bolt is employed, in contrast to other forms of rock bolts discussed above, where the weak strata renders them ineffective, or not sufficiently effective. That is, a rock bolt according to the present invention employs an anchor arrangement that engages with the surrounding weak strata in a way that is effective to fix the rock bolt in place within the weak strata.

The displaceable wall section can have any suitable form. In some forms of the invention, the displaceable wall section is a section of the wall of the tube that is separated from the surrounding tube by a groove or slot, so that it can be displaced outwardly from the tube wall. When the displaceable wall section is displaced out from the tube wall, a void or opening in the tube wall is formed. The displaceable wall section is thus formed as a cut out portion of the tube wall with the hinge end remaining connected to the tube wall. The displaceable wall section can thus be formed integrally with the tube at the hinge end and can be otherwise disconnected or separated from the tube other than at the hinge end. This facilitates relatively easy formation of the displaceable wall section. Where the tube is formed from a flat sheet or flat tube blank that is processed by rolling into a tube, the displaceable wall section can be defined by a groove or slot that extends along the side walls and along the anchor end to form a separation between the displaceable wall section and the adjacent flat sheet or flat tube blank. The groove or slot can be punched or laser cut for example. In these forms of the invention, the displaceable wall section can be displaced by the expander mechanism pushing against the inside of the displaceable wall section to cause the displaceable wall section to displace outwardly by plastic deformation of the connection between the hinge end and the tube. The plastic deformation means the displaceable wall section will remain in the position it is displaced to in absence of forces displacing the wall section inwardly or further outwardly.

The integral connection between the displaceable wall section and the tube can be a weakened section to facilitate displacement. The length of the connection can be selected based on the level of effort intended to be required to rotate the displaceable wall section. A shorter connection section will require less effort to rotate the displaceable wall section than a longer connection section. Two or more short connection sections may be preferred to a single connection section. Thus, the integral connection between the displaceable wall section and the tube can be a perforated section or an interrupted section. Alternatively, the integral connection could be stamped or pressed to have a thinner wall thickness compared to the remainder of the tube and/or the displaceable wall section. It is to be noted that an integral connection between the displaceable wall section and the tube will likely be curved given that the tube is generally circular and so the curvature in the connection will add resistance to bending.

In some forms of the invention, the hinge end of the displaceable wall section includes a hinge portion that is connected to the tube and free portion on either side of the hinge portion that is disconnected from the tube and that extends to the side walls of the displaceable wall section, so that the hinge portion commences inboard of the side walls. The length of the hinge portion can be adjusted to increase or decrease the level of effort required to rotate the displaceable wall section.

In other forms of the invention, the displaceable wall section can be separately connectable to the tube, such as by a hinge connection that enables rotation of the wall section about the hinge end. The hinge connection could comprise a separate link connection for example.

While a single displaceable wall section can be provided, two displaceable wall sections can alternatively be provided in which the displaceable wall sections are spaced about the circumference of the tube. These displaceable wall sections can for example, be spaced diametrically opposite each other, or diametrically opposed. A pair of displaceable wall sections can provide better anchorage of the rock bolt in a hole and can provide better balance of the anchorage as compared to a single displaceable wall section.

In other forms of the invention, three or four displaceable wall sections can be provided and in these forms of the invention, the displaceable wall sections can be equidistantly spaced about the circumference of the tube. If three displaceable wall sections are provided in a tube that has been formed with a longitudinal split for use in a split set, the displaceable wall sections can be other than equidistantly spaced given the existence of the longitudinal split. Again, multiple displaceable wall sections can provide better anchorage of the rock bolt in a hole and can provide better balance of the anchorage.

Thus, the invention contemplates the use of one displaceable wall section, or multiple displaceable wall sections, such as two, three or four displaceable wall sections, whereby the multiple displaceable wall sections are formed at the same axial position in the tube.

In other forms of the invention, multiple displaceable wall sections can be provided longitudinally of, or axially spaced along the tube. In some forms of the invention, first and second displaceable wall sections can be provided in axially spaced positions along the tube, with the first displaceable wall section proximal the leading end of the tube and the second displaceable wall section axially spaced towards the trailing end of the tube. Further displaceable wall sections can be provided axially spaced along the tube as required. Moreover, instead of spacing single displaceable wall sections axially apart, pairs of displaceable wall sections can be axially spaced along the tube. Thus, a first pair of diametrically opposed displaceable wall sections can be provided proximal the leading end of the tube and a second pair of diametrically opposed displaceable wall sections can be provided axially spaced towards the trailing end of the tube. Of course, two, three or more displaceable wall sections can be provided in groups at longitudinally spaced positions along the tube, while the number of displaceable wall sections in a group can vary at the longitudinal positions, so that a pair of diametrically opposed displaceable wall sections might be provided proximal the leading end of the tube and a group of three equidistantly spaced displaceable wall sections can be provided on the opposite side axially spaced towards the trailing end of the tube.

It is expected that at least one displaceable wall section will be provided at, or adjacent to, or towards the leading end of the tube. In prototype forms of the invention, a pair of displaceable wall sections is provided at, or adjacent to, or towards the leading end of the tube. Axial spacing of additional displaceable wall sections can be made along the length of the tube at any suitable intervals.

Multiple displaceable wall sections can improve the anchorage of the rock bolt and rock bolts having different numbers and placement of displaceable wall sections can be offered to customers so that the customer can select preferred number of displaceable wall sections depending on the particular site of installation and the rock strata at that site. The provision of multiple displaceable wall sections provides for a greater number of embedments into the surrounding rock strata and into different sections of the rock strata that might have better compressive strength for improved engagement with a displaceable wall section to improve the resistance to longitudinal movement of the rock bolt.

Where multiple displaceable wall sections are provided axially of the tube, the expander mechanism can be arranged to displace the displaceable wall sections simultaneously, or in any suitable sequence.

The displaceable wall section can have a generally square or rectangular configuration. In this form of the invention, the side walls can be generally parallel and the anchor end can form bottom edge that is generally perpendicular to the side walls. The anchor end can be generally parallel to the axis about which the displaceable wall section rotates about the hinge end. This is simple and easy to form and provides an effective anchor. In other forms of the invention, the side walls can be mutually inclined, either towards or away from each other when viewed from the hinge end. The side walls can be inclined symmetrically or asymmetrically to each other. The anchor end can present a straight edge, or a curved edge, or the edge can be otherwise configured for interaction with the strata it is to engage with or in. The edge of the anchor end can, for example, be formed serrated. The anchor end could alternatively be a point or an apex, so that the side walls of the displaceable wall section incline to a point or apex, with the point or apex enabling the anchor end of the displaceable wall section to dig into the rock strata.

The expander mechanism can take any suitable form. In some forms of the invention, the expander mechanism includes a mobile wedge that is connected to the elongate bar or cable and that can be shifted within the tube to displace the displaceable wall section. The expander mechanism can also include a displaceable wedge with which the mobile wedge interacts. The displaceable wedge is associated with the inside of the displaceable wall section, so that the mobile wedge can be shifted axially in a direction towards the trailing end of the tube and interact with the displaceable wedge to cause the displaceable wall section to rotate about the hinge end. This wedge arrangement can be employed to displace a single displaceable wall section, or multiple displaceable wall sections, whereby each displaceable wall section of the multiple displaceable wall sections has an associated displaceable wedge.

The interacting wedge surfaces will be inclined and can be flat or planar, or they can be concave or convex. Interaction between these surfaces prevents the mobile wedge from rotating within the tube.

The mobile wedge can be restrained against axial or longitudinal movement beyond the displaceable wedge or wedges so that the mobile wedge remains in contact with the displaceable wedge or wedges in the displaced condition of the displaceable wall section or sections. By that arrangement, the mobile wedge resists return movement of the displaceable wall section or sections and the associated displaceable wedge or wedges, or in other words, maintains the displaceable wall section or sections and the associated displaceable wedge or wedges in the displaced position.

The mobile wedge can be restrained against axial or longitudinal movement beyond the displaceable wedge or wedges by the displaceable wall section or sections being restrained to rotate to a maximum rotation at which no further rotation about the hinge ends can take place. At the point of maximum rotation, the mobile wedge will jam in contact with the displaceable wedge or wedges as further movement of the mobile wedge requires further outward rotation of the displaceable wall section or sections and the associated displaceable wedge or wedges. The jammed mobile wedge is firstly prevented from moving to further displace the displaceable wall section or sections, and secondly is firmly in contact with the wedge surfaces of the displaceable wedge or wedges.

Displacement of the displaceable wall section or sections and the associated displaceable wedge or wedges can be restrained by including a retainer, such as a catch, skirt or flange, that engages the inside surface of the tube when the displaceable wall section or sections have reached the point of maximum displacement, so that interaction between the retainer and the inside surface of the tube prevents further rotating movement of the displaceable wall section or sections.

This results in jamming of the mobile wedge as discussed above. The retainer can be an extension of the inside wedge surface of the displaceable wedge or wedges. Alternatively, the retainer can extend from a lower or bottom region of the displaceable wedge or wedges or from a side edge or surface of the displaceable wedge or wedges.

In other forms of the invention, the mobile wedge can engage an internal abutment of the tube at the point of maximum displacement of the displaceable wall section or sections, or, if the rock bolt employs an elongate bar rather and the mobile wedge is threaded to the elongate bar, the thread can be terminated at the point of maximum displacement so that the mobile wedge reaches the end of the thread at the point of maximum displacement and cannot move further. In addition to terminating the thread, the elongate bar can include an abutment, such as a collar, to prevent further movement of the mobile wedge.

Advantageously, the restraint to movement of the mobile wedge can be used to identify to the installer that the mobile wedge has displaced the displaceable wall section or sections the maximum amount, so that no further actuation of expander mechanism is required. Accordingly, when the mobile wedge reaches the point at which it cannot move any further, the installer has a positive indication that the rock bolt has been fully installed.

The displaceable wedge can be a solid body with an internally facing wedge surface. The displaceable wedge can be formed by a steel investment casting, or alternatively it could be sand cast, forged or machined. The displaceable wedge will be subjected to high compression stresses so they need to be strong.

The displaceable wedge can be attached to the inside surface of the displaceable wall section by welding, brazing or soldering for example. Alternatively, the displaceable wedge can be connected to the displaceable wall section by suitable fasteners, such as rivets or screws.

The displaceable wedge can extend for substantially the full length of the displaceable wall section, or for a portion of the displaceable wall section. The longer the displaceable wedge, the shallower the inclination of the internal wedge surface can be and that can reduce the effort required to rotate the displaceable wall section about the hinge end. The reduced effort relates to the effort required to shift the mobile wedge relative to the displaceable wedge or wedges.

The mobile wedge can be fixed to an elongate bar or an elongate cable, depending on the type of rock bolt that the invention is employed in. If an elongate bar is employed, the leading end of the bar can be threaded as discussed above and the mobile wedge can be moved within the tube by rotating the bar relative to the mobile wedge, so that the mobile wedge moves along the threaded section of the bar. The bar can be formed with an integral nut at the trailing end that can be driven by a hydraulic driver for example. Alternatively, if a cable is employed, the mobile wedge can be fixed to one end of the cable and the cable can be pulled or tensioned to move the mobile wedge within the tube.

The tube can be a split tube that is itself expandible between a contracted, smaller diameter and an expanded larger diameter. This allows the rock bolt to frictionally engage the inside surface of hole where the structure of the hole allows this.

BRIEF DESCRIPTION OF DRAWINGS

In order that the invention may be more fully understood, some embodiments will now be described with reference to the figures in which.

DETAILED DESCRIPTION

Figure 1:
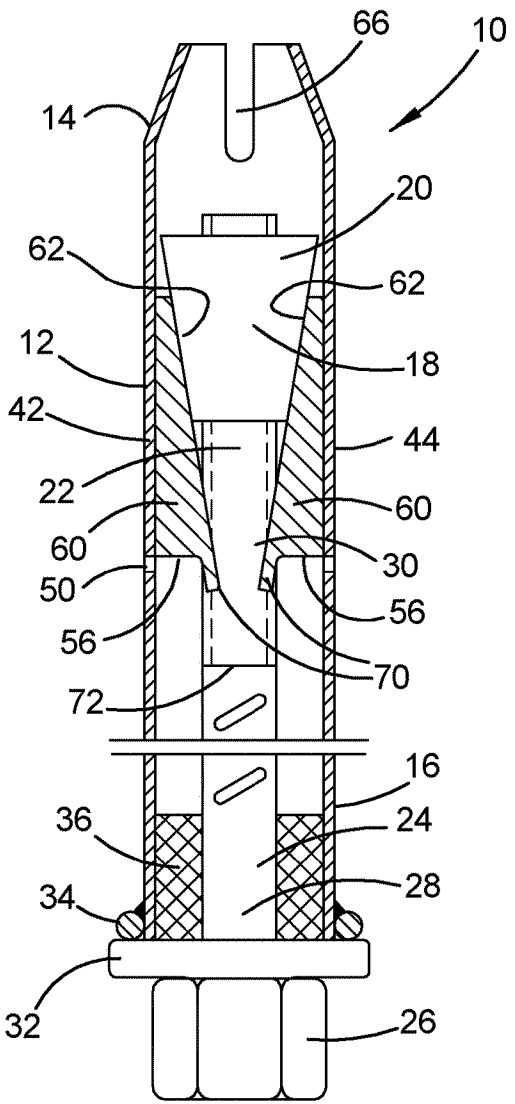
FIG. 1 is a cross-sectional view of a rock bolt according to one embodiment of the invention with the rock bolt in a pre-deployed state.

FIG. 1 is a cross-sectional view of a rock bolt 10 according to one embodiment of the invention with the rock bolt in a pre-deployed state and ready for installation in a drilled bore or hole. The rock bolt 10 includes an elongate, generally circular tube 12 that has a leading end 14 and a trailing end 16. The length of the rock bolt 10 would ordinarily be in the order of about 2 m, and so the bolt 10 is shown in FIG. 1 with a break through the length of the tube 12.

The tube 12 is formed with a gap or split along its full length (see the split 68 shown in FIG. 5 and described later herein) so that the rock bolt 10 is known as a "split set" as previously described. The split is not visible in FIG. 1 or 2. Thus, in normal operations where the rock strata can support a split set, the tube 12 would be percussion driven into a hole that has an inner diameter which is smaller than the outside diameter of the tube 12. The tube 12 would thus radially contract in diameter to fit into the hole and by that contraction, would frictionally engage the inner surface of the hole. The split set is held within the hole by that frictional engagement. In some forms, the present invention modifies the split tube 12 as described below to enable it to anchor within rock strata that does not have sufficient structural integrity to anchor by frictional engagement only. As would be apparent from the foregoing discussion, the present invention has been developed for installation of the rock bolt 10 in rock strata which is weak so that the frictional engagement normally employed by a split set does not appropriately anchor the rock bolt within the hole.

The bolt 10 includes an expander mechanism 18 that includes a mobile wedge 20 that is threadably connected to the leading end 22 of an elongate rod 24. The rod 24 extends for substantially the full length of the tube 12, between the leading and trailing ends 14, 16 of the tube 12. The leading end 14 of the rod 24 is threaded and the wedge 20 is threadably connected to the leading end 22. The trailing end 16 of the rod 24 is formed as a nut 26 so that the nut 26 and the rod 24 are integrally connected. Rotation of the nut 26 rotates the rod 24 and by restraining the wedge 20 against rotation with the rod 24, the wedge 20 can be shifted on the threaded section 30 lengthwise of the rod 24.

In a cable bolt, the wedge can be fixed to the leading end of the cable and the wedge can be shifted longitudinally within the tube by pulling or tensioning the trailing end of the cable. The trailing end of the cable can be anchored at the trailing end of the rock bolt by what is known as a barrel and wedge arrangement, which allows the cable to be pulled or tensioned in one direction and which clamps the cable against movement in the opposite direction.

Figure 2:
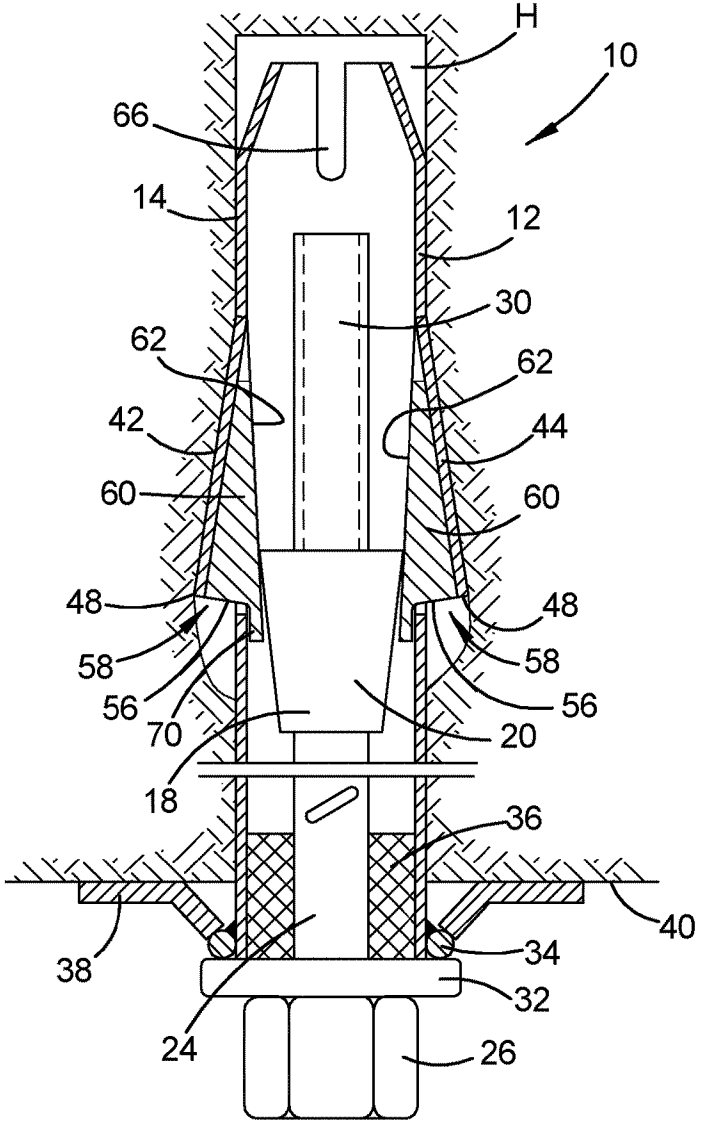
FIG. 2 is a cross-sectional view of the rock bolt of FIG. 1 with the rock bolt in a deployed state.

Returning to FIG. 1, the nut 26 bears against a washer 32 which in turn bears against a circular ring 34 that is welded to an outer surface of the tube 12. When the rock bolt 10 is installed in a hole, the ring 34 bears against a rock plate. This arrangement is shown in FIG. 2 in which the bolt 10 is shown installed within a hole H. In FIG. 2, the sleeve 36 in engagement with a rock plate 38 that bears against a facing surface 40 of the rock strata within which the bolt 10 is installed.

The rock bolt 10 includes a pair of diametrically opposed displaceable wall sections 42 and 44. The wall sections 42 and 44 are shown in FIG. 1 coextensive with the tube 12, while in FIG. 2, they are shown displaced outwardly, embedded in the rock strata.

Figure 3:
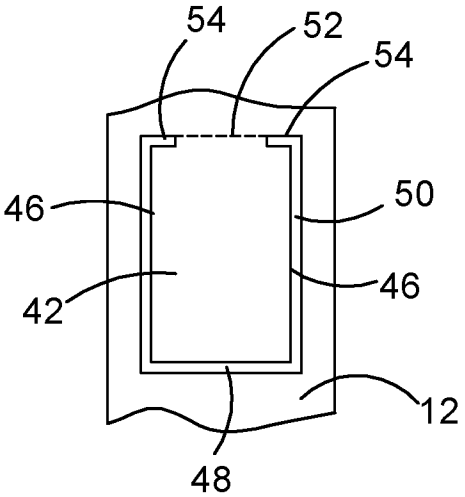
FIG. 3 is a view of the displaceable wall section of the rock bolt of FIG. 1.

A single displaceable wall section 42 is shown in FIG. 3 and that figure shows that the wall section 42 is formed to be generally rectangular so that the wall section 42 has a pair of generally parallel side walls 46 and a bottom edge 48. The wall section 42 is separated from the surrounding tube 12 by a groove or slot 50. The slot 50 can be cut into the tube 12 before the tube 12 is formed/rolled into its circular configuration. Thus, the groove 50 can be cut into a flat metal sheet or flat tube blank prior to the blank being rolled to form the tube 12. The groove 50 can be cut in any suitable manner, such as by laser, water jet or flame. The groove 50 can also be cut into a tube that has already been formed/rolled, by cutting or stamping.

The wall section 42 remains connected to the tube 12 at a hinge end or section 52. The groove 50 include two inwardly depending free portions or groove sections 54 which terminate prior to meeting, so that the hinge section 52 is left in place and thus connects the wall section 42 to the adjacent part of the tube 12. The inwardly depending groove sections 54 are not essential, but the provision of the sections 54 reduces the effort required for the outward displacement of the wall section 42 from the coextensive position shown in FIG. 1, to the displaced position shown in FIG. 3. The sections 54 can be longer or shorter than shown in FIG. 3 to alter the effort required for the outward displacement of the wall section 42. If the sections 54 are shorter, then the effort increases, because the amount of metal between the wall section 42 and the tube 12 that needs to be bent for the wall section 42 to displace outwardly increases. Likewise, if the sections 54 are longer, the amount of metal between the wall section 42 and the tube 12 reduces and so the effort to bend the wall section 42 about the hinge section 52 reduces.

As previously described, the rock bolt 10 has been developed for use in strata that is relatively weak, for example in strata that has been that has been consolidated with cement paste. The rock bolt 10 is intended to provide a more secure anchorage within the hole H (FIG. 2) within which the bolt 10 is installed, compared to traditional frictional rock bolts that anchor within a hole by virtue of frictional engagement with the facing walls of the hole. In contrast, the bolt 10 shown in the figures anchors within the hole H by displacement of the wall sections 42 and 44 outwardly to the position shown in FIG. 2, so that the wall sections 42 and 44 gouge into and become embedded in the surrounding rock strata and by that embedding, the bolt 10 is securely anchored within the rock strata. In particular, the bottom edge 48 of the wall sections 42 and 44 forms an anchor end of the sections 42 and 44 that tends to dig into the strata 58 immediately below it, thus resisting longitudinal movement of the bolt 10 within the hole H.

The wall sections 42 and 44 are shifted between the coextensive position shown in FIG. 1 and the outwardly displaced position shown in FIG. 2 by movement of the mobile wedge 20 relative to fixed wedges 60 that are connected to or fixed to the inside surface of each of the wall sections 42 and 44. The fixed wedges 60 can be fixed to the inside surface of the wall sections 42 and 44 in any suitable manner, such as by welding, soldering, brazing, or by fastener fixing.

Figure 4:
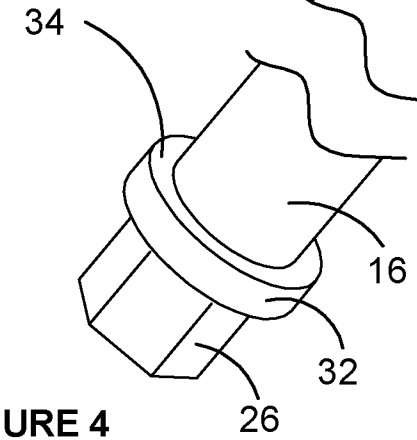
FIG. 4 is a perspective view of the rock bolt of FIG. 2.

Each of the fixed wedges 60 has an inclined wedge surface 62. The wedge surfaces 62 can be flat or planar, or they can be slightly concave or convex. The outside surface of the mobile wedge 20 is likewise inclined and has a profile to match the surface of the fixed wedges 60. As will be evident from the transition of the wall sections 42 and 44 between FIGS. 1 and 2, as the mobile wedge 20 is shifted along the threaded section 30 of the rod 24 in the direction of the trailing end 28 of the rod 24, the wall sections 42 and 44 are pushed outwardly, rotating about the hinge section 52 to reposition the bottom edge 48 of each wall section 42 and 44 into the adjacent rock strata 58. A perspective view of the rock bolt 10 showing the wall sections 42 and 44 displaced outwardly from the tube 12 in accordance with FIG. 2 is shown in FIG. 4.

Thus, to displace the wall sections 42 and 44 outwardly, the nut 26 is rotated by a suitable driver, such as a hydraulic driver, so that the rod 24 rotates. The mobile wedge 20 is restrained against rotation with the rod 24 by the engagement of the inclined wedge surface 62 of the wedge 20 with the wedge surfaces 62 of the fixed wedges 60. The wedge 20 thus shifts longitudinally downwardly along the threaded section 30 from the upper position shown in FIG. 1 to the lower position shown in FIG. 2.

As the wedge 20 shifts along the threaded section 30 of the rod 24, the wall sections 42 and 44 are simultaneously pushed or displaced outwardly. The effort to displace the wall sections 42 and 44 outwardly is the sum of the effort required to bend the metal of the tube 12 in the hinge section plus the effort required to displace the rock strata for the wall sections 42 and 44 to push into the rock strata.

It may not be necessary for the wall sections 42 and 44 to be displaced to their maximum displacement as shown in FIG. 2. The rock strata may have sufficient integrity that it resists the wall sections 42 and 44 being displaced to the maximum displacement. Moreover, the rock bolt 10 may achieve some frictional anchorage by engagement between the outside surface of the tube 12 and the facing surface of the hole H. That frictional anchorage may vary along the length of the tube 12. However, the rock bolt 10 is intended to anchor within the hole H principally by the displaced wall sections 42 and 44 embedding in the rock strata and any additional anchorage achieved through frictional engagement with the facing surface of the hole H is beneficial to the security of the anchorage but is not relied on.

The wedge 20 may therefore be driven to a position that is intermediate the upper position of FIG. 1 and the lower position of FIG. 2. The hydraulic drive may include a limiter that applies a maximum torque to the nut 26, so that once that maximum torque has been reached, no matter if the wedge 20 has not reached the maximum displaced position of the wall sections 42 and 44 shown in FIG. 2, the nut 26 is no longer rotated.

It will be appreciated that regardless of the position to which the wedge 20 is driven on the threaded section 30 of the rod 24, the wedge 20 will remain in contact with the inclined wedge surfaces 62 of the fixed wedges 60 and thus will resist return movement of the wall sections 42 and 44 from the displaced position. While the wall sections 42 and 44 will not naturally return from the displaced positions because bending of the hinge section 52 is plastic and thus permanent, movement of the rock strata can push against the displaced wall sections 42 and 44 and so the continued contact between the wedge 20 and the fixed wedges 60 resists any inward pushing load and thus ensures that the wall sections 42 and 44 retain their displaced position.

Figure 5:
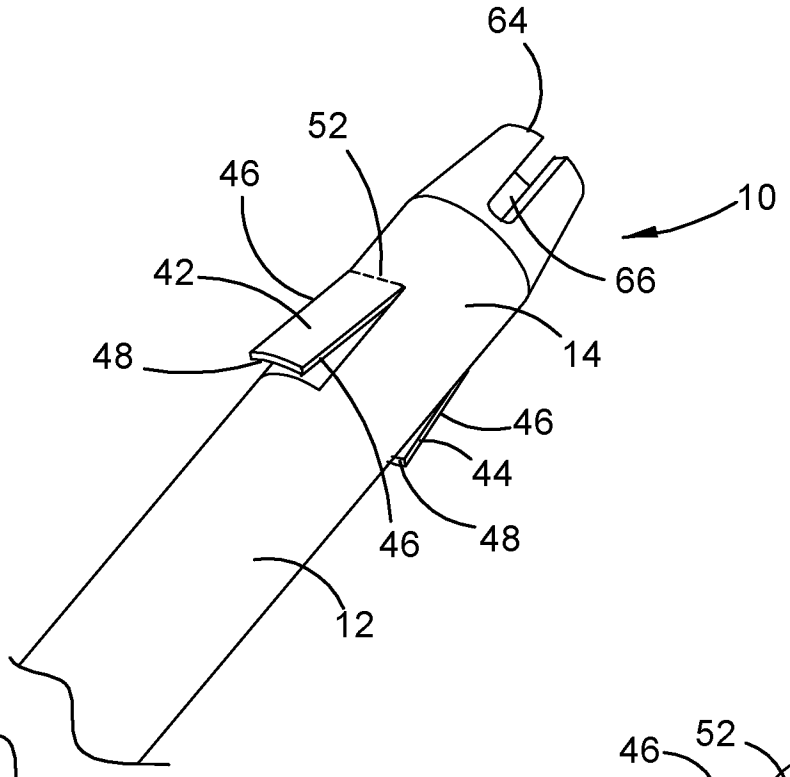
FIG. 5 is an end view of the rock bolt of FIG. 2.
Figure 5:
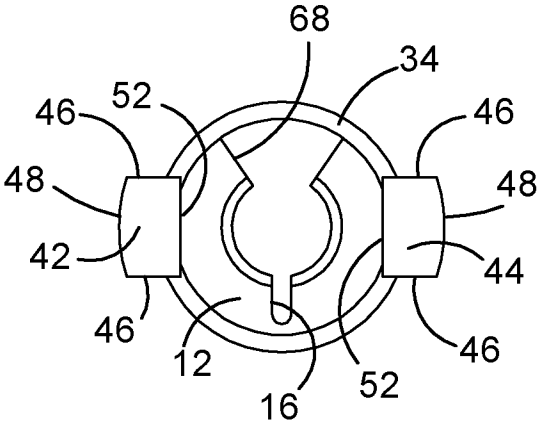

FIG. 5 is an end view of FIG. 4 taken from the leading end 14 of the tube 12. FIG. 5 thus shows the very top edge 64 of the tube 12, along with the short split 66 that is created in the flat tube blank so that the leading end 14 can be formed into a cone to assist entry of the leading end 14 into the opening of the hole H. FIG. 5 further shows the split 68 that extends along the full length of the tube 12 to form the rock bolt 10 as a split set as previously described.

FIG. 5 illustrates the displaceable wall sections 42 and 44 in the displaced positions of FIGS. 2 and 4 and illustrates the continued connection between the wall sections 42 and 44 with the tube 12 at the hinge sections 52.

Referring back to FIG. 2, in the displaced position of the displaceable wall sections 42 and 44, the bottom edge 48 or anchor end of the wall sections 42 and 44 has been pushed into the rock strata surrounding the tube 12. As shown in FIGS. 1 and 2, the wedges 60 have a bottom face 56 and as shown in FIG. 2, that face 56 is solid rather than open, which gives strength to the wedges 60 and gives them a greater area for contact with the rock strata in which they embed improving resistance to movement and removal of the rock bolt 10 from the hole H.

The inclined wedge surfaces 62 continue beyond the bottom edge 48 of the wall sections 42 to form a retainer 70. The retainers 70 set the maximum angle of rotation of the wall sections 42 and 44 about the hinge sections 52. As shown in FIG. 1, prior to deployment of the wall sections 42 and 44, the retainers 70 are inside the tube 12 and extend to either side of the rod 24. This can occur because the retainers are curved and curve about the rod 24, or the retainers 70 can include a gap for the rod 24 to pass through. When the wall sections 42 and 44 have been displaced to the maximum displacement positions of FIG. 2, the retainers 70 shift to a position of engagement with the inside surface of the tube 12 directly below where the bottom edge 48 of the wall sections 42 and 44 is positioned the FIG. 1. It will be appreciated that once the retainers 70 engage against the inside surface of the tube 12, no further outward displacement of the wall sections 42 and 44 is possible. This is advantageous from the perspective of preventing over displacement of the wall sections 42 and 44. Over displacement would be problematic if the wall sections 42 and 44 were to displace to a position in which they could pass through a 90° rotation and thus experience a loss in the anchoring effect they provide, such as in the position shown in FIG. 2. This over displacement could occur for example, if the rock strata below the wall sections 42 and 44 were to shift and to drag the trailing end 16 of the tube 12 downwardly.

The retainers 70 also provide additional benefits to the installation and operation of the rock bolt 10. When the retainers 70 engage against the inside wall of the tube 12, the mobile wedge 20 is prevented from further downward movement on the threaded section 30 of the rod 24. This gives installation personnel a tactile indication that the wall sections 42 and 44 have reached their maximum displaced position so that the installation personnel are aware that the rock bolt 10 has been appropriately deployed within the hole H. As indicated above, in the maximum displaced positions, the wedge 20 remains in contact with the inclined wedge surfaces 62 of the wedges 60, thus preventing inward return of the wall sections 42 and 44.

The retainers 70 could be formed inboard of the position shown in FIGS. 1 and 2, so that they could extend from the bottom face 56 between the wall sections 42 and 44 and the inclined wedge surfaces 62 of the wedges 60 in order to change the maximum displaced position of the wall sections 42 and 44.

The wedge 20 can be controlled in the maximum amount of travel it has relative to the rod 24 by terminating the threaded section 30. This is seen in FIG. 1 in which the rod 24 transitions from the threaded section 30 to a non-threaded bar at transition point 72. The rod 24 could be widened at the transition point 72 to provide an actual stop that the wedge 20 engages at the point of maximum travel.

With reference to FIG. 5, it would be evident that a third displaceable wall section could be included in the tube 12 midway between the wall sections 42 and 44 and in line with the short split 66. A fourth wall section, opposite the third wall section, could not be included, as that section of the tube 12 is the longitudinal split 68. However, in rock bolt tubes that are not formed as split sets so that they do not employ a longitudinal split, a fourth wall section could be employed, so that the first pair of wall sections 42 and 44 would be accompanied by a second set of diametrically opposed wall sections, with the four wall sections equidistantly spaced apart. The wedge 20 could be arranged to cooperate with a third wall section, or a third and fourth wall section.

It is also possible that additional wall sections could be formed in the wall of the tube 12 axially spaced beneath the wall sections 42 and 44, either directly beneath them, or displaced circumferentially to be offset from the upper wall sections. For this, the expander mechanism 18 would need to be modified, such as to include two or more axially spaced mobile wedges.

Those skilled in the art will appreciate that the invention described herein is susceptible to variations and modifications other than those specifically described. It is understood that the invention includes all such variations and modifications which fall within the spirit and scope of the present invention.

The invention claimed is:

1. A rock bolt comprising:

an elongate, circular tube, the tube having a leading end and a trailing end;

an expander mechanism disposed within the tube in a region of the leading end; and an elongate bar or cable disposed longitudinally within the tube and in connection at or towards a first end of the bar or cable with the expander mechanism and in connection at or towards a second and opposite end of the bar or cable with an anchor arrangement positioned at the trailing end of the tube, the elongate bar or cable being actuatable to actuate the expander mechanism and to remain connected between the expander mechanism and the anchor arrangement when the expander mechanism is actuated, wherein the tube has at least one displaceable wall section in the region of the leading end the displaceable wall section having a hinge end proximal to the leading end connecting the at least one displaceable wall section to the tube, and side walls extending from the hinge end to an anchor end distal to the leading end the expander mechanism being actuatable to displace the at least one displaceable wall section to rotate about the hinge end to shift the anchor end outwardly from the tube.

2. The rock bolt according to claim 1, wherein the at least one displaceable wall section is formed integrally with the tube at the hinge end.

3. The rock bolt according to claim 2, wherein the at least one displaceable wall section is disconnected from the tube other than at the hinge end.

4. The rock bolt according to claim 1, wherein the at least one displaceable wall section is a section of wall of the tube that is separated from the surrounding tube by a groove or slot, so that the at least one displaceable wall section can be displaced outwardly from the tube wall.

5. The rock bolt according to claim 4, wherein the displaceable wall section is disconnected from the tube other than at the hinge end.

6. The rock bolt according to claim 1, wherein the hinge end of the at least one displaceable wall section includes a hinge portion that is connected to the tube and a free portion on either side of the hinge portion that is disconnected from the tube and that extends to the side walls of the at least one displaceable wall section.

7. The rock bolt according to claim 1, wherein the at least one displaceable wall section is separately connectable to the tube.

8. The rock bolt according to claim 1, wherein the at least one displaceable wall section comprises two displaceable wall sections at a same axial position of the tube and spaced apart about a circumference of the tube, such as and diametrically opposed.

9. The rock bolt according to claim 1, characterised by including wherein the at least one displaceable wall section comprises at least two displaceable wall sections axially spaced apart longitudinally along the tube.

10. The rock bolt according to claim 9, wherein the at least one displaceable wall section comprises a first group of displaceable wall sections is provided proximal the leading end of the tube and a second group of displaceable wall sections is provided axially spaced towards the trailing end of the tube.

11. The rock bolt according to claim 9, wherein the at least one displaceable wall section comprises a first pair of diametrically opposed displaceable wall sections provided proximal the leading end of the tube and a second pair of diametrically opposed displaceable wall sections provided axially spaced towards the trailing end of the tube.

12. The rock bolt according to claim 1, wherein the at least one displaceable wall section has a square or rectangular configuration.

13. The rock bolt according to claim 1, wherein the expander mechanism includes a mobile wedge and a displaceable wedge, the mobile wedge being connected to the elongate bar or cable and the displaceable wedge being associated with the inside of the at least one displaceable wall section, whereby actuation of the bar or cable is operable to shift the mobile wedge axially within the tube and to interact with the displaceable wedge to displace the at least one displaceable wall section to rotate about the hinge end.

14. The rock bolt according to claim 13, wherein the at least one displaceable wall section is restrained against rotation beyond a maximum rotation by a retainer that engages an inside surface of the tube when the at least one displaceable wall section has reached a point of maximum displacement to prevent further rotating movement of the at least one displaceable wall section.

15. The rock bolt according to claim 14, wherein retainer extends from a lower or bottom region of the displaceable wedge.

16. The rock bolt according to claim 1, wherein the tube includes a longitudinal split extending a length of the tube through the leading and trailing ends.

17. The rock bolt according to claim 16, wherein the at least one displaceable wall section comprises a pair diametrically opposed displaceable wall sections provided proximal the leading end of the tube.

* * * * *